US010875335B2

(12) United States Patent
McNestry et al.

(10) Patent No.: US 10,875,335 B2
(45) Date of Patent: Dec. 29, 2020

(54) STEPPER MOTOR DRIVEN PRINT HEAD

(71) Applicant: VIDEOJET TECHNOLOGIES INC., Wood Dale, IL (US)

(72) Inventors: Martin McNestry, Derbyshire (GB); Philip Hart, Nottinghamshire (GB); Gary Pfeffer, Nottingham (GB)

(73) Assignee: VIDEOJET TECHNOLOGIES INC., Wood Dale, IL (US)

( * ) Notice: Subject to any disclaimer, the term of this patent is extended or adjusted under 35 U.S.C. 154(b) by 828 days.

(21) Appl. No.: 14/901,576

(22) PCT Filed: Oct. 10, 2014

(86) PCT No.: PCT/GB2014/053050
§ 371 (c)(1),
(2) Date: Dec. 29, 2015

(87) PCT Pub. No.: WO2015/052531
PCT Pub. Date: Apr. 16, 2015

(65) Prior Publication Data

US 2016/0185146 A1 Jun. 30, 2016

Related U.S. Application Data

(60) Provisional application No. 61/840,270, filed on Jun. 27, 2013.

(30) Foreign Application Priority Data

Oct. 11, 2013 (GB) ..... 1318042.7
Oct. 14, 2013 (GB) ..... 1318176.3
Oct. 21, 2013 (GB) ..... 1318581.4

(51) Int. Cl.
*B41J 33/00* (2006.01)
*B41J 25/312* (2006.01)
(Continued)

(52) U.S. Cl.
CPC ..... *B41J 33/003* (2013.01); *B41J 3/4075* (2013.01); *B41J 25/312* (2013.01); *B41J 33/16* (2013.01)

(58) Field of Classification Search
CPC ..... B41J 33/003; B41J 25/312; B41J 3/4075; B41J 33/16
See application file for complete search history.

(56) References Cited

U.S. PATENT DOCUMENTS 4,594,597 A * 6/1986 Liu ..... B41J 13/223 101/409
5,702,192 A * 12/1997 Matsuhashi ..... B41J 2/325 400/586
(Continued)

FOREIGN PATENT DOCUMENTS

EP 0856409 8/1998
EP 1142717 10/2001
(Continued)

*Primary Examiner* — Sang K Kim
*Assistant Examiner* — Nathaniel L Adams
(74) *Attorney, Agent, or Firm* — Wolter Van Dyke Davis, PLLC; Robert L. Wolter

(57) ABSTRACT

A thermal transfer printer comprising: first and second spool supports each being configured to support a spool of ribbon; a ribbon drive configured to cause movement of ribbon from the first spool support to the second spool support; a printhead configured to selectively transfer ink from the ribbon to a substrate, the printhead pressing the print ribbon and substrate together against a print roller; a substrate drive configured to cause movement of a substrate past the printhead; a sensor configured to monitor rotation of the print roller and generate a signal indicative thereof; and a controller configured to determine a measure of movement of the substrate and/or ribbon past the print roller based on the signal output by the sensor.

15 Claims, 11 Drawing Sheets

(51) Int. Cl.
*B41J 33/16* (2006.01)
*B41J 3/407* (2006.01)

(56) References Cited

U.S. PATENT DOCUMENTS

| | | | | |
|---|---|---|---|---|
| 7,001,089 | B2 * | 2/2006 | Tozaki | B41J 11/0095<br>400/708 |
| 2005/0225625 | A1 | 10/2005 | Sawai | |
| 2008/0217455 | A1 * | 9/2008 | McNestry | B41J 2/325<br>242/334.6 |
| 2013/0215210 | A1 * | 8/2013 | McNestry | B41J 33/14<br>347/214 |
| 2016/0096382 | A1 * | 4/2016 | Kojima | B41J 13/0009<br>347/220 |

FOREIGN PATENT DOCUMENTS

| | | |
|---|---|---|
| EP | 1950046 | 7/2008 |
| EP | 1479525 | 7/2014 |
| FR | 2783451 | 3/2000 |
| JP | S6072777 | 4/1985 |
| JP | HO82078 | 1/1996 |
| JP | HO82078 A * | 1/1996 |
| JP | 2006095950 | 4/2006 |

* cited by examiner

STEPPER MOTOR DRIVEN PRINT HEAD

The present invention relates to a thermal transfer printer and to a labelling machine. More particularly, but not exclusively, the invention relates to techniques for monitoring movement of substrate and/or ribbon past a print roller. The invention also relates to printers and methods for controlling the pressure exerted by a printhead on a printing surface against which printing is to take place.

Thermal transfer printers use an ink carrying ribbon. In a printing operation, ink carried on the ribbon is transferred to a substrate which is to be printed. To effect the transfer of ink, the print head is brought into contact with the ribbon, and the ribbon is brought into contact with the substrate. The print head contains printing elements which, when heated, whilst in contact with the ribbon, cause ink to be transferred from the ribbon and onto the substrate. Ink will be transferred from regions of the ribbon which are adjacent to printing elements which are heated. An image can be printed on a substrate by selectively heating printing elements which correspond to regions of the image which require ink to be transferred, and not heating printing elements which correspond to regions of the image which require no ink to be transferred.

It is known that various factors affect print quality. For example it is important that the printhead is properly positioned relative to the printing surface and also important that the printhead applies an appropriate pressure to the printing surface and the ribbon and substrate which is sandwiched between the printhead and the printing surface.

Movement of the printhead relative to the printing surface is, in some prior art thermal transfer printers, effected pneumatically by an air cylinder which presses the printhead into contact with the printing surface and any substrate and ribbon located between the printhead and the printing surface. Such an arrangement is effective but has associated disadvantages. In particular, it is usually not readily possible to vary the pressure applied by the printhead, and use of the printer requires an available supply of compressed air.

It is often desirable to accurately monitor motion of a substrate on which printing is taking place past the printhead. While various mechanisms have been described for such monitoring these mechanisms all have their attendant disadvantages.

It is an object of some embodiments of the present invention to provide a novel thermal transfer printer which obviates or mitigates at least some of the disadvantages set out above.

According to a first aspect of the invention, there is provided a thermal transfer printer comprising: first and second spool supports each being configured to support a spool of ribbon; a ribbon drive configured to cause movement of ribbon from the first spool support to the second spool support; a printhead configured to selectively transfer ink from the ribbon to a substrate, the printhead pressing the print ribbon and substrate together against a print roller; a substrate drive configured to cause movement of a substrate past the printhead; a sensor configured to monitor rotation of the print roller and generate a signal indicative thereof; and a controller configured to determine a measure of movement of the substrate and/or ribbon past the print roller based on the signal output by the sensor.

The first aspect of the invention therefore provides a mechanism for monitoring movement of the print roller and using the monitored movement to determine movement of the substrate and/or the ribbon. The use of the print roller for such monitoring is advantageous because the printhead presses the ribbon and substrate against the print roller thereby meaning that movement of the print roller should be a good indicator of movement of the substrate and the print ribbon. That is, there should be relatively little (or no appreciable) slip between the substrate and/or print ribbon and the print roller.

The controller may be configured to determine a measure of movement of the substrate and/or ribbon past the print roller based upon the signal output by the sensor and a quantity indicative of a diameter of the printroller.

The signal output by the sensor may comprise a plurality of pulses. A known number of pulses may be generated by the sensor for a single rotation of the print roller. Monitoring a number (which need not be an integer number) of rotations of a print roller of known diameter provides a straightforward way of determining linear distance.

The quantity indicative of the diameter of the print roller may be a quantity indicative of an effective diameter of the print roller as determined by the controller based upon a quantity indicative of the pressure applied by the printhead to the ribbon and the substrate against the print roller.

That is, while the pressure applied by the printhead to the print ribbon and substrate against the print roller makes rotation of the print roller an accurate indication of linear movement of the print ribbon and the substrate, the applied pressure may affect the diameter of the print roller. For example, where the print roller has an outer surface defined by a resilient material (e.g. an elastomeric material such as a silicone rubber), the applied pressure may compress the resilient material in the region of the print roller against which the printhead presses. The resilient material may expand in other regions of the print roller. This may be particularly important where the substrate and/or ribbon passes such parts of the print roller which are caused to expand. This may have the effect of reducing or increasing the effective diameter of the print roller, the extent of change of diameter being determined by the pressure applied for a given resilient material. It is desirable in such a case to determine the effective diameter of the print roller given the applied pressure, particularly where the diameter of the print roller is used in determination of linear displacement of the substrate and/or the print ribbon.

The quantity indicative of the pressure may be at least partially based upon the force applied by the printhead to the ribbon and substrate against the print roller. The quantity indicative of the pressure may be at least partially based upon a parameter indicating a size of the print roller. For example, where the printer can be operated with different widths of print roller it is desirable to take print roller width into account in determining the pressure applied and therefore the effective diameter of the print roller.

The thermal transfer printer may further comprise a motor configured to cause movement of the printhead towards and away from the print roller. The controller may be configured to provide a control signal to the motor to cause the motor to press the printhead against the print roller. The control signal may be generated or selected to cause a particular desired pressure to be applied to the print ribbon and substrate against the print roller.

The controller may be configured to generate the control signal by: obtaining a pressure to be applied to the print roller; and generating a control signal to be applied to the motor to cause the printhead to press against the printing surface with the obtained pressure.

The motor, which may be a position controlled motor such as a stepper motor, may be coupled to the printhead by an inelastic coupling such as a timing belt.

The elasticity provided by internal components of the motor may be greater than the elasticity of the coupling between the printhead and the motor shaft. The elasticity provided by the internal components of the motor may be provided by deviation of a rotor of the motor relative to the magnetic field in the stator of the motor from a position to which the rotor is commanded to move.

The quantity indicative of an effective diameter of the print roller may be determined based upon said control signal.

The substrate drive may comprise a substrate motor arranged to cause movement of the substrate past the printhead and the print roller. The controller may control the substrate drive at least partially based upon the signal output by the sensor. The substrate drive may comprise a stepper motor and the controller may control the stepper motor.

There is also provided a labelling machine which incorporates a thermal transfer printer as described above. In such a case the substrate is a label web comprising a plurality of labels affixed to a backing paper. The substrate drive may comprises a first and second substrate spool supports, the first substrate spool support being arranged to support a spool of label carrying web and the second substrate spool support being arranged to support a spool of web from which at least some labels have been removed. The motor of the substrate drive may drive the second substrate spool supports.

The labelling machine may also comprise a labelling station arranged to remove labels from the label carrying web, the labelling station being located on a label path between the first and second substrate spool support.

There is also provided a labelling machine comprising first and second ribbon spool supports each being configured to support a spool of ribbon; a ribbon drive configured to cause movement of ribbon from the first spool support to the second spool support; first and second label spool supports, the first label spool support being configured to support a spool of label carrying web and the second label spool support being configured to support a spool of web from which at least some labels have been removed; a printhead configured to selectively transfer ink from the ribbon to labels of the label web, the printhead pressing the print ribbon and label web together against a print roller; a label web drive configured to cause movement of the label web past the printhead; a sensor configured to monitor rotation of the print roller and generate a signal indicative thereof; and a controller configured to determine a measure of movement of the label web and/or ribbon past the print roller based on the signal output by the sensor.

According to a second aspect of the invention, there is provided, a thermal transfer printer comprising: first and second spool supports each being configured to support a spool of ribbon; a ribbon drive configured to cause movement of ribbon from the first spool support to the second spool support; a printhead configured to selectively transfer ink from the ribbon to a substrate; a motor configured to cause movement of the printhead towards and away from a printing surface against which printing is carried out, the motor being coupled to the printhead by an inelastic coupling; and a controller configured to provide a predetermined control signal to the motor to cause the motor to press the printhead against the printing surface.

The coupling between the printhead and the motor may be a coupling between the output shaft of the motor and the printhead. Given that the coupling between the motor and the printhead is inelastic, the force applied by the printhead to the printing surface is determined by the control signal provided to the motor. The motion of the motor may start when the printhead is spaced apart from the printing surface. The motion of the motor may then cause the printhead to move towards the printing surface. Once initial contact between the printhead and the printing surface is made, commanding the motor to move further in the same direction will cause the pressure exerted by the printhead on the printing surface to increase.

The motor may be provided with a positional control signal during this motion. Where the motor is a stepper motor, as the pressure between the printhead and the printing surface increases the rotor of the motor will be unable to move in response to commands to move further towards the printing surface. The rotor of the motor can exhibit a difference in movement compared to the commanded movement of approximately two steps of the motor's native resolution without stalling. Current applied to windings of the stepper motor will determine the ease with which the rotor of the motor can be pushed in the direction opposite to that in which the stepper motor is being commanded to move, with higher current requiring greater pressure for the same movement of the stepper motor.

In other embodiments the motor may be a DC motor. In such a case the pressure exerted by the printhead on the printing surface is a function of the current applied to the DC motor, given the well-known torque-current relationship which is inherent in a DC motor.

In some embodiments the printing surface may be resilient and in such a case the pressure between the printhead and printing surface is determined by characteristics of the motor and the resilience of the printing surface.

The inelastic coupling may provide a synchronous drive between the motor shaft and the printhead. This allows the pressure exerted by the printhead against the printing surface to be quickly and effectively varied based upon the signal applied to the motor. The inelastic nature of the coupling may be such that greatest elasticity in the system is provided by the internal components of the motor. That is to say, the elasticity provided by internal components of the motor is greater than the elasticity of the coupling between the printhead and the motor shaft. The inelastic coupling may comprise a timing belt.

The elasticity provided by the internal components of the motor may be provided by deviation of a rotor of the motor, relative to the magnetic field created by the stator of the motor, from a position to which the rotor is commanded to move. That is, where the motor is a stepper motor, the elasticity may be provided by the step position error which the rotor exhibits relative to a step position to which it has been commanded to move. It is known that for a stepper motor, the torque provided at the motor shaft varies in accordance with a torque angle characteristic which determines how the torque provided at the motor shaft varies in dependence upon step position error. An example of a torque angle characteristic is shown in FIG. 11 and it can be seen to approximate a sine wave. It can be seen that the torque provided at the motor shaft is zero when the step position error is zero. The torque increases until the step position error is a full motor step at which point the torque has a maximum value. As the step position error increases beyond a full motor step, the torque decreases until it reaches zero at a step position error of two full motor steps.

In the configuration described here, when the motor is commanded to move to a position which is not adopted because of the interaction between the printhead and the printing surface, a step position error is thereby created and the step position error causes the motor to exhibit a torque which is manifested as a pressure applied by the printhead to the printing surface. It is known that the torque exhibited varies in accordance with the torque angle characteristic and further known that the torque angle curve is determined by the current supplied to the motor and the geometry of rotor and stator of the motor. It will be appreciated that where 'steps' are described here, the description applies to both full steps and micro-steps as commonly used in stepper motor control systems.

A timing belt used to couple the motor shaft to the printhead may be formed of two materials a first having a relatively high tensile strength and a second having a relatively low tensile strength. The second material may deformable and/or have a relatively high coefficient of friction (relative to the coefficient of friction of the first material). For example the second material may be polyurethane and the first material may be a metal. For example, the timing belt may be a metal-banded timing belt. The metal may be steel.

The timing belt passes around first and second pulley wheels, the motor being coupled to the first pulley wheel and the printhead being coupled to the second pulley wheel, such that rotation of the motor causes rotation of the first pulley wheel, movement of the timing belt and movement of the second pulley wheel. In this way movement of the motor may be transmitted to the printhead via the first and second pulley wheels and the timing belt passing therearound.

The printhead may be arranged to rotate together with the second pulley wheel, such that rotation of the motor causes pivoting of the printhead towards or away from the printing surface.

In general, the motor may be arranged to cause the printhead to rotate about a pivot. Rotation about the pivot may cause movement of the printhead towards and away from the printing surface.

The printhead may be part of a printhead assembly and the printhead assembly may be mounted on the motor shaft. For example the motor shaft may extend through a mounting provided by the printhead assembly.

The motor may take any suitable form. For example, the motor may be a position controlled motor such as a stepper motor.

The control signal provided to the motor may be a positional control signal intended to move the motor against the printing surface and increase pressure between the printhead and the printing surface.

The controller may be configured to determine the control signal by obtaining a pressure to be applied to the printing surface; and generating a control signal to be applied to the motor to cause the printhead to press against the printing surface with the obtained pressure.

The controller may be configured to obtain data indicating a speed at which the ribbon is to pass the printhead during printing and obtain data indicating the pressure which the printhead should apply to the printing surface based upon the obtained speed. This may be useful where the pressure which should be exerted by the printhead on the printing surface varies depending upon a printing speed.

The control signal may be a positional control signal. Such a control signal may be provided to a stepper motor, a DC servo motor or indeed any other form of motor. For example, where a stepper motor is used the control signal may be a control signal comprising a number of steps and a rotational direction of movement.

The printer may further comprise a sensor configured to transmit signals indicative of movement of the printhead towards and away from the printing surface, wherein the controller is configured to monitor signals received from the sensor indicating movement of the printhead and to determine a printhead position based upon the provided signal and the monitored signals.

The printer may store data indicating a relationship between a provided signal and monitored signals. Such a relationship may indicate monitored signals which should be expected to be received by the controller in response to a particular provided signal. For example, where the motor is a stepper motor the stored data may indicate an expected ratio between pulses provided to the stepper motor and sensor signals which are received. Where the printhead is arranged to pivot towards and away from the printing surface the sensor may be a rotary encoder monitoring rotation of the printhead about the pivot.

The controller may be configured to determine a printhead position based upon monitored sensor signals which are not substantially in accordance with the stored relationship.

The controller may be configured to determine that the printhead contacts a stop when the monitored sensor signals are not substantially in accordance with the stored relationship.

The controller may be configured to position the printhead at a predetermined position relative to the printing surface. The controller may be configured to position the printhead against the printing surface and apply a predetermined movement to the printhead so as to locate the printhead at a predetermined location relative to the surface against which printing is carried out.

The controller may be configured to provide a signal to the motor to cause predetermined movement of the printhead such that the printhead bears against the printing surface with predetermined pressure. That is, the movement of the printhead may be determined so as to cause the printhead to apply a desired pressure to the printing surface. For example a look up table may be provided associating particular pressures with particular movement, such that a particular desired pressure may be looked up to determine a movement to be made.

The controller may be configured to determine the pressure which is being applied by the printhead to the printing surface by comparing the monitored sensor signals and the stored relationship. Such comparison may then be used to determine a control signal provided to the motor. In this way a closed-loop control system may be provided which is arranged so as to cause the printhead to bear against the printing surface with a predetermined pressure.

According to a third aspect of the invention, there is provided a thermal transfer printer comprising: first and second spool supports each being configured to support a spool of ribbon; a ribbon drive configured to cause movement of ribbon from the first spool support to the second spool support; a printhead configured to selectively transfer ink from the ribbon to a substrate, the printhead being moveable towards and away from a printing surface against which printing is carried out; a sensor configured to transmit signals indicative of actual movement of the printhead towards and away from the printing surface; a motor arranged to move the printhead relative to the printing surface; and a controller configured to provide a signal to the motor intended to cause movement of the printhead relative to the printing surface; to monitor signals received from the sensor indicating actual movement of the printhead; and to determine a printhead position based upon the provided signal and the monitored signals.

The third aspect of the invention generates information indicating printhead position based upon both signals provided to a motor and signals received from a sensor. Where the motor is commanded to move but movement is impeded there will be a discrepancy between the commanded movement and the sensed movement. Such a discrepancy can be used to determine that the printhead is located in a position whereby its movement is impeded.

According to a fourth aspect of the invention there is provided a thermal transfer printer comprising first and second spool supports each being configured to support a spool of ribbon; a ribbon drive configured to cause movement of ribbon from the first spool support to the second spool support; a printhead configured to selectively transfer ink from the ribbon to a substrate, the printhead being moveable towards and away from a printing surface against which printing is carried out; a sensor configured to transmit signals indicative of actual movement of the printhead towards and away from the printing surface; a motor arranged to move the printhead relative to the printing surface; and a controller configured to determine an absolute position of the printhead based upon said signals indicative of actual movement of the printhead.

The fourth aspect of the invention may therefore allow information relating to absolute position of the printhead in space to be determined based upon information indicating relative movement of the printhead.

Any feature described in the context of one aspect of the invention can be applied to other aspects of the invention.

Embodiments of the invention will now be described, by way of example, with reference to the accompanying drawings, in which.

Figure 1:
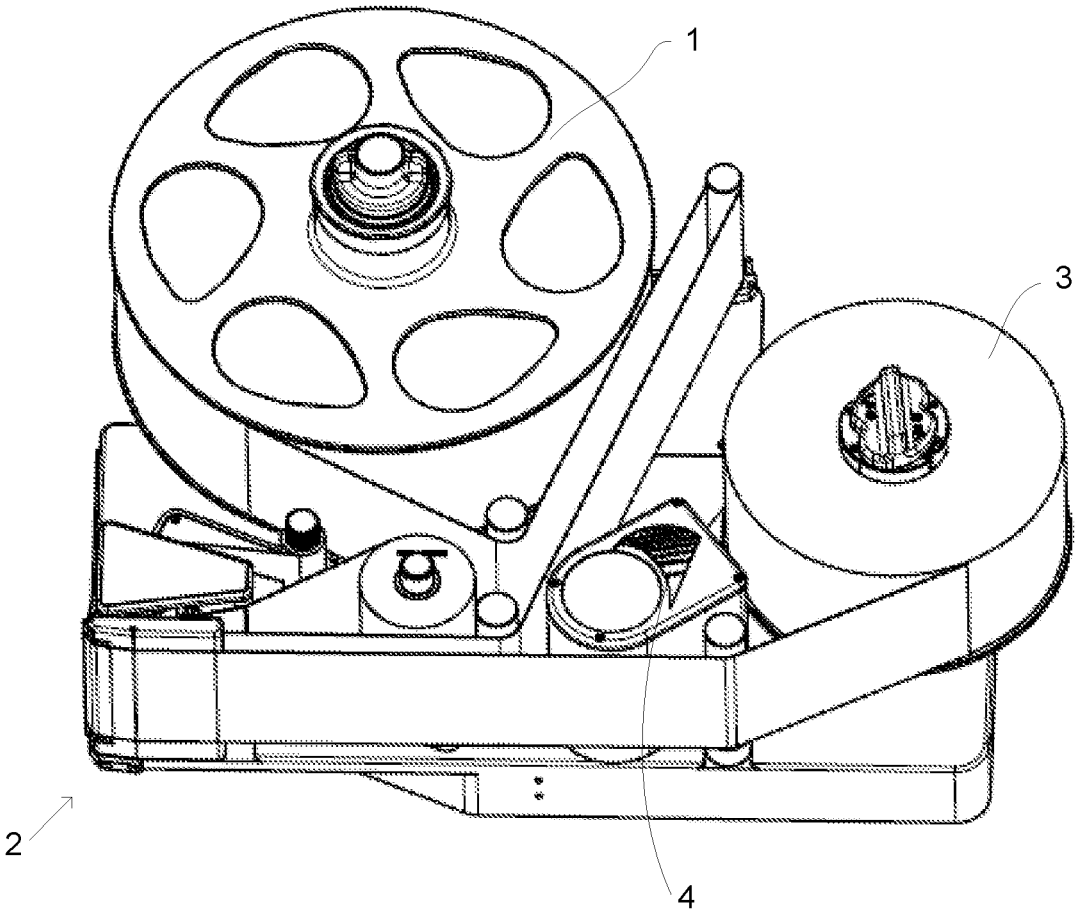
FIG. 1 is a perspective view of a print and apply labeling machine including a printer in accordance with the present invention.

Referring to FIG. 1, there is illustrated a print and apply labeling machine in which label web material is provided on a label supply spool 1 and is conveyed through a labeling station 2 to a label take up spool 3. The label web material comprises a plurality of labels which are affixed to a backing paper and the labeling station is arranged to remove labels from the backing paper such that the labels are affixed to packages which are conveyed passed the labeling station 2. The backing paper is then taken up by the label take up spool 3.

A motor 4 is coupled to the label take up spool 3 via a belt drive (not shown) thereby causing rotation of the take up spool 3 and consequently movement of the label web from the label supply spool 1 to the label take up spool 3 through the labeling station 2.

The labeling station 2 includes a thermal transfer printer which is arranged to print on labels of the label web as they pass through the labeling station 2 and before they are removed from the backing paper. The thermal transfer printer is shown in further detail in FIG. 2.

Figure 2:
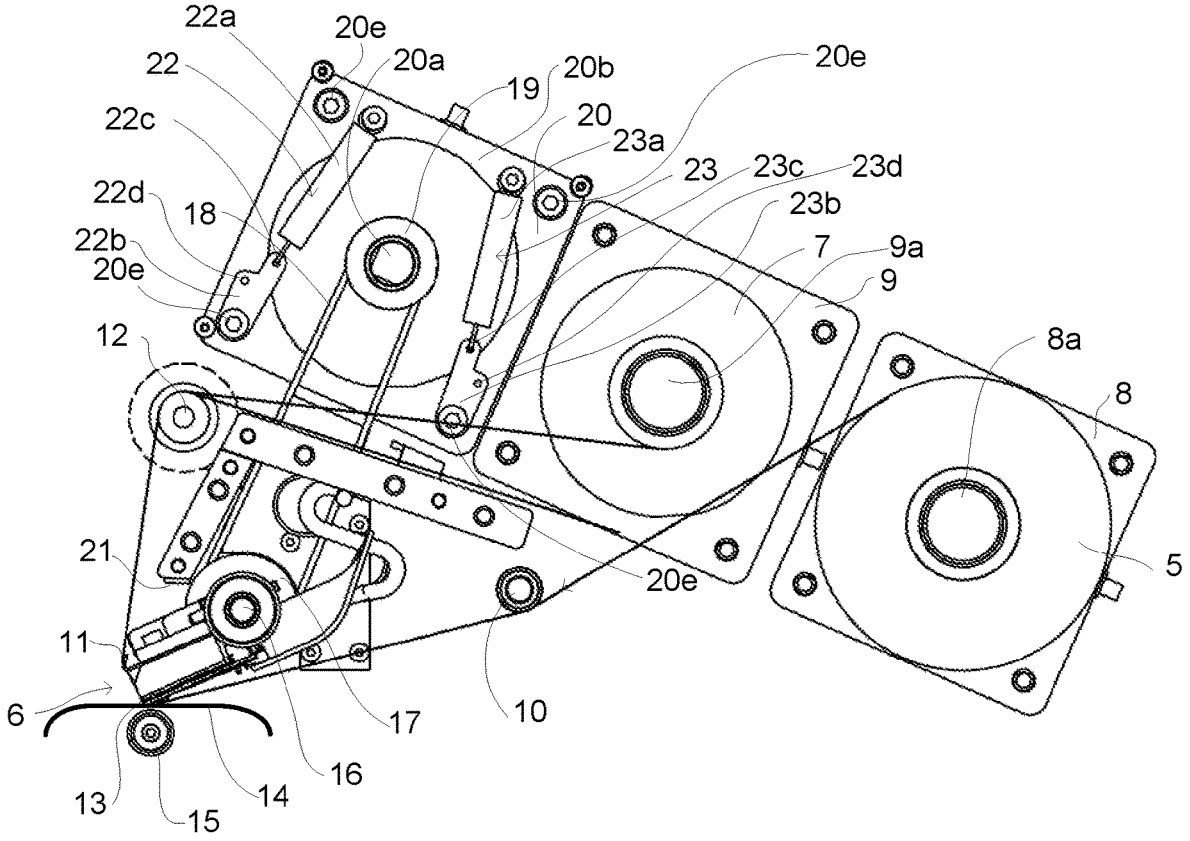
FIG. 2 is an illustration showing part of the printer of FIG. 1 in further detail with the base plate removed for clarity.

Referring to FIG. 2, ink carrying ribbon is provided on a ribbon supply spool 5, passes a printhead assembly 6 and is taken up by a ribbon take-up spool 7. The ribbon supply spool 5 is driven by a stepper motor 8 while the ribbon take-up spool is driven by a stepper motor 9. In the illustrated embodiment the ribbon supply spool 5 is mounted on an output shaft 8*a* of its stepper motor 8 while the ribbon take-up spool 7 is mounted on an output shaft 9*a* of its stepper motor 9. The stepper motors 8, 9 may be arranged so as to operate in push-pull mode whereby the stepper motor 8 rotates the ribbon supply spool 5 to pay out ribbon while the stepper motor 9 rotates the ribbon take-up spool 7 so as to take up tape. In such an arrangement, tension in the ribbon may be determined by control of the motors. Such an arrangement for transferring tape between spools of a thermal transfer printer is described in our earlier U.S. Pat. No. 7,150,572, the contents of which are incorporated herein by reference.

In other embodiments the ribbon may be transported from the ribbon supply spool 5 to the ribbon take up spool 7 past the printhead assembly 6 in other ways. For example only the ribbon take up spool may be driven by a motor while the ribbon supply spool 5 is arranged so as to provide resistance to ribbon motion, thereby causing tension in the ribbon. That is, the motor 8 driving the ribbon supply spool 5 may not be required in some embodiments. Resistance to ribbon movement may be provided by a slipping clutch arrangement on the supply spool. In some embodiments the motors driving the ribbon supply spool 5 and the ribbon take up spool 7 may be motors other than stepper motors. For example the motors driving the ribbon supply spool 5 and the ribbon take up spool 7 may be direct current (DC) motors. In general the motors driving the ribbon supply spool 5 and/or the ribbon take up spool 7 may be torque controlled motors (e.g. DC motors) or position controlled motors (e.g. stepper motors, or DC servo motors).

Ribbon paid out by the ribbon supply spool 5 passes a guide roller 10 before passing the printhead assembly 6. The ribbon is guided by a ribbon guide 11 of the printhead assembly 6 before passing around a further guide roller 12 and subsequently being taken up by the ribbon take up spool 7.

In some embodiments rotation of the guide roller 12 is monitored in a manner similar to that described in earlier European Patent No. EP0814960 so as to determine a diameter of one of the ribbon spools 5, 7. Specifically by monitoring rotation of the guide roller 12 and a spool of interest a ratio of rotations can be determined. Given knowledge of the diameter of the guide roller 12 the diameter of the spool of interest can then be determined. However, contrary to the method described in EP0814960 the spool of interest is not rotated a predetermined amount. Rather, the spool of interest is rotated so as to cause the guide roller to rotate a predetermined amount. In this way the predetermined rotation of the guide roller can be equated to monitored rotation of the spool of interest to allow the diameter of the spool of interest to be determined given the known diameter of the guide roller.

The printhead assembly 6 comprises a printhead 13 which presses the ribbon and label web 14 against a print roller 15 to effect printing. The printhead 13 is a thermal transfer printhead comprising a plurality of printing elements, each arranged to remove a pixel of ink from the ribbon and to deposit the removed pixel of ink on a substrate. The printhead assembly 6 is mounted to a base plate (not shown) for rotation about a pivot 16 thereby allowing the printhead 13 to be moved towards or away from the print roller 15. For this purpose the printhead assembly comprises a pulley wheel 17 having 30 teeth. A belt 18 passes around the pulley wheel 17 and about a drive wheel 19 having 23 teeth. The drive wheel 19 is mounted on an output shaft 20*a* of a stepper motor 20 such that rotation of the stepper motor 20 causes rotation of the drive wheel 19, causing movement of the belt 18 and consequent rotation of the pulley wheel 17 and movement of the printhead 13 towards or away from the print roller 15. In one embodiment the belt 18 is a Synchroflex® AT3 Gen III Timing Belt from the Conti® Synchroflex range of ContiTech AG, the belt having a length of 300 mm and a width of 10 mm. The stepper motor 20 may be a 86 mm frame size hybrid stepper motor such as a that available from Portescap having part number 34H118D30B.

It is well known that timing belts should be properly tension to ensure correct operation and long life.

During installation of the stepper motor 20 in the printer, the stepper motor 20 is mounted to the base plate of the printer via a pair of resilient biasing means 22, 23, and screws 20*e* are loose. The resilient biasing means 22, 23 each comprise a spring 22*a*, 23*a* and brackets 22*b*, 23*b*. The brackets 22*b*, 23*b* are each connected to their respective spring 22*a*, 23*a* by an end of each spring being received by a respective first hole 22*c*, 23*c* in the respective bracket 22*b*, 23*b*. A second end of each spring 22*a*, 23*a* is connected to the base plate via respective screws. Each bracket is also connected to an outer housing 20*b* of the stepper motor 20 via screws.

Because the stepper motor 20 is mounted to the base plate via the resilient biasing means 22, 23, the resilient biasing means exert a force on the stepper motor 20. In this way the force is a biasing force which acts so as to urge the stepper motor 20 towards second ends of the springs 22*a*, 23*a*.

Because the printhead assembly 6 is mounted to the base plate and because the stepper motor is urged by the resilient biasing means 22, 23 towards the second ends of the springs (which are connected to the base plate), when the screws 20*e* are loose, the biasing means act so as to urge the stepper motor away from the printhead assembly 6 thereby tensioning the belt 18. In this way the belt 18 can be tensioned to a particular desired tension by the resilient biasing means 22, 23, and the screws 20*e* can be tightened to maintain the particular desired tension in the belt 18 during operation of the printer. When the screws 20*e* are tightened the resilient biasing means has no effect on the position of the motor or the tension in the belt 18.

It will be appreciated that whilst the resilient biasing means include springs 22*a*, 23*a* and brackets 22*b*, 23*b*, any appropriate biasing means may be used to position the stepper motor 20 so as to allow the belt to be properly tensioned before the screws 20*e* are tightened. Furthermore it will be also appreciated that the tension in the belt 18 is determined by the force applied by the resilient biasing means to the stepper motor 20. Consequently by the use of the resilient biasing means which are configured to apply different forces to the stepper motor 20 the belt can be differently tensioned. For example, the brackets 22*b*, 23*b* of the resilient biasing means 22, 23 include second holes 22*d*, 23*d*. Connection of the first ends of the springs 22*a*, 23*a* to those second holes 22*d*, 23*d* (as opposed to the first holes 22*c*, 23*c*) will cause a different extension of the springs 22*a*, 23*a* and consequently a different force exerted on the stepper motor and thereby a different tension in the belt 18. For example if the springs 22*a*, 23*a* are extension springs placing the first end of each of the springs 22*a*, 23*a* in the second hole 22*d*, 23*d* of each bracket 22*b*, 23*b* will result in a greater extension of the springs 22*a*, 23*a* compared to their extension when the first ends are received in the first holes 22*c*, 23*c*. This will result in the resilient biasing means exerting a greater force on the stepper motor 20 and therefore a greater tension in the belt.

The resilient biasing means 22, 23 is configured such that when the screws 20*e* are tightened to secure the stepper motor 20 to the base plate in a position determined by the resilient biasing means 22, 23, the belt 18 is inelastic in its behaviour.

The extent of rotation of the printhead assembly 6 about the pivot 16 is limited by a first point at which the printhead 13 contacts the print roller 15 and a second point at which an opposite side of the print head assembly 6 contacts a stop 21.

Figure 3:
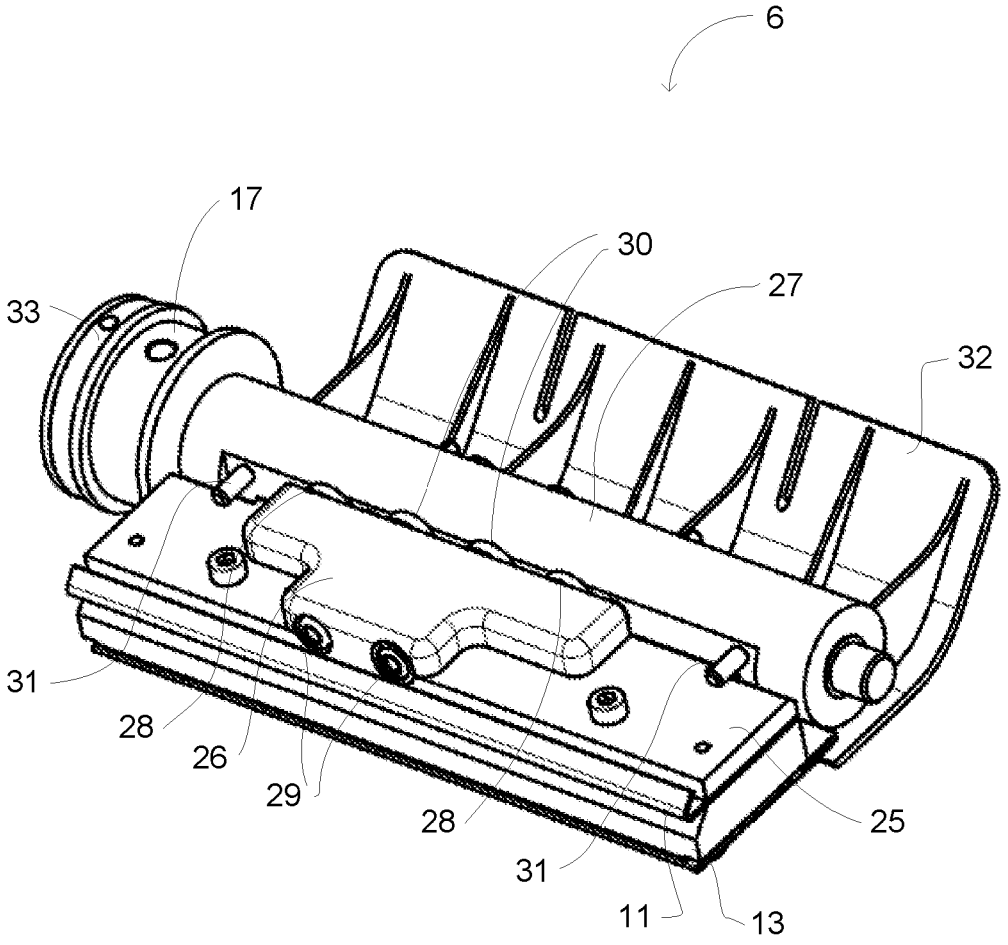
FIG. 3 is a perspective view of a printhead assembly of the printer of FIG. 2.
Figure 4:
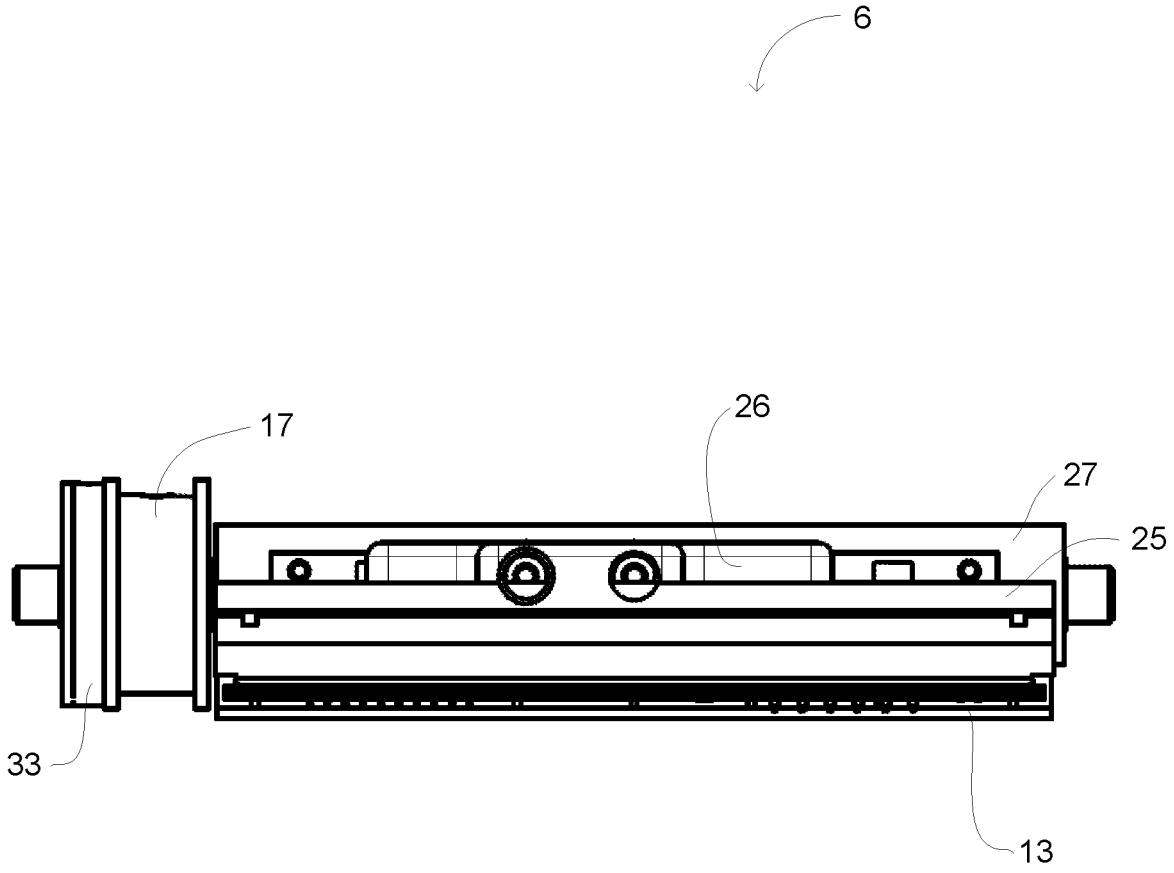
FIG. 4 is an alternative view of the printhead assembly of FIG. 3.

FIGS. 3 and 4 show the printhead assembly 6 in further detail. The printhead 13 is attached to a carrier plate 25. Interposed between the printhead 13 and the carrier plate 25 is the ribbon guide 11 which, as best seen in FIG. 2 acts to guide the ribbon along its path. The carrier plate 25 comprises an attachment member 26 which in turn magnetically attaches to a shaft 27 via magnetic attachments 28. The attachment member 26 comprises two channels 29 which are each arranged to receive a respective pivot 30. In use, only one of the channels 29 is provided with a bush such that the attachment member pivots about the pivot 30 received in that channel, the other pivot 30 having clearance to move in its respective channel. The pivoting motion of the attachment member 26 (and consequently the printhead 13) is limited by two end stops 31. The ability of the printhead to pivot about one of the pivots 30 allows for proper alignment between the printhead 13 and the print roller 15 during printing which is important to ensure good quality printing.

To ensure good quality print it is desirable to apply pressure to the printhead 13 at approximately the centre of the label being printed on. The provision of two channels 29 allows the pressure point to be changed to accommodate narrower widths of labels more optimally. For best results when printing on narrower labels a narrower print roller may also be used.

The printhead assembly 6 further comprises a cable guide member 32 providing for convenient routing of cables providing signals to the printhead 13.

The shaft 27 is arranged to rotate about the pivot 16. The printhead assembly 6 is provided with a magnetic element 33, rotation of which is monitored by a magnetic encoder (not shown). In this way rotation of the printhead assembly 6—as caused by movement of the belt 18—about the pivot 16 can be monitored. The magnetic element may be a magnetic multipole ring as supplied by Austria Microsystems with part number AS5000-MR20-44. The encoder may be a rotary magnetic position sensor, also supplied by Austria Microsystems and having part number AS5304.

It has been described above that the motor 20 acts to move the printhead 13 towards and away from the print roller 15. The motor 20 also acts to control the pressure which the printhead 13 applies to the print roller 15. The control of the applied pressure is important as it is a factor which affects the quality of printing.

Figure 5:
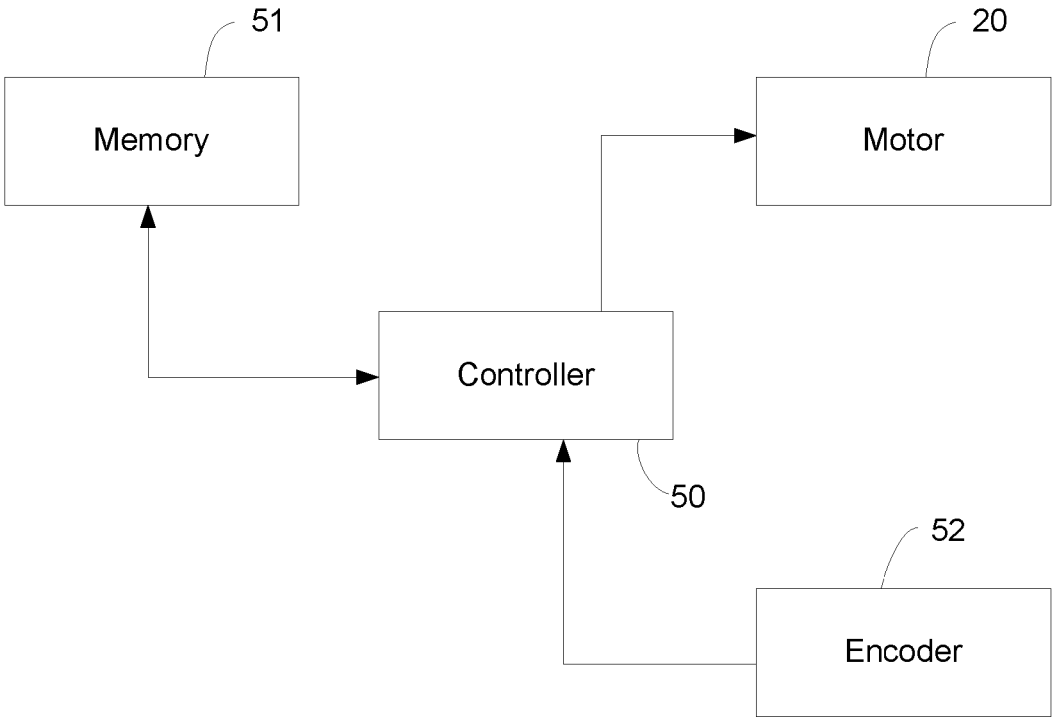
FIG. 5 is a schematic illustration of a controller arranged to control components of the printer of FIG. 2.

FIG. 5 is a schematic illustration of components involved in the control of printhead position and pressure. The stepper motor 20 is controlled by a microcontroller 50 which reads instructions from a memory 51. An encoder 52 transmits signals to the controller indicating rotational movement of the printhead assembly 6 about the pivot 16. The controller provides signals to the motor 20.

Control of printhead position and pressure by control of the stepper motor 20 is now described with reference to FIG. 6. Steps S1 to S3 represent an initialization process. At step S1 the motor 20 is controlled so as to rotate the drive wheel 19 to move the belt 18 and pulley wheel 17 and consequently to rotate the printhead assembly about the pivot 16. This movement is continued until the printhead assembly 6 is in a position where it abuts the stop 21 (FIG. 2). At step S2 a calibration process is carried out to determine how movement of the stepper motor 20 through one step corresponds to pulses transmitted by the encoder 52 which monitors rotation of the printhead assembly 6 about the pivot 16. At step S3 the motor 20 is rotated such that the printhead assembly 6 is moved to a home position which is located close to but spaced apart from the stop 21.

The initialisation process of steps S1 to S3 is carried out each time the labeling device of FIG. 1 is powered up.

At step S4, when the printer is placed on-line, the printhead assembly is moved to a ready to print position which is closer to the print roller 15. In order to carry out a printing operation the printhead is moved from the ready to print position to the print position at step S5. In the print position the printhead bears against the print roller 15 thereby applying pressure to the print roller 15 (or in use to the ribbon and substrate sandwiched between the printhead 13 and the print roller 15).

When a printing operation is complete processing passes from step S5 to step S4 to thereby cause the printhead assembly 6 to return to the ready to print position. When the printer is placed in an offline mode, processing passes from step S4 to step S3 such that the printhead assembly 6 returns to its home position.

Figure 6:
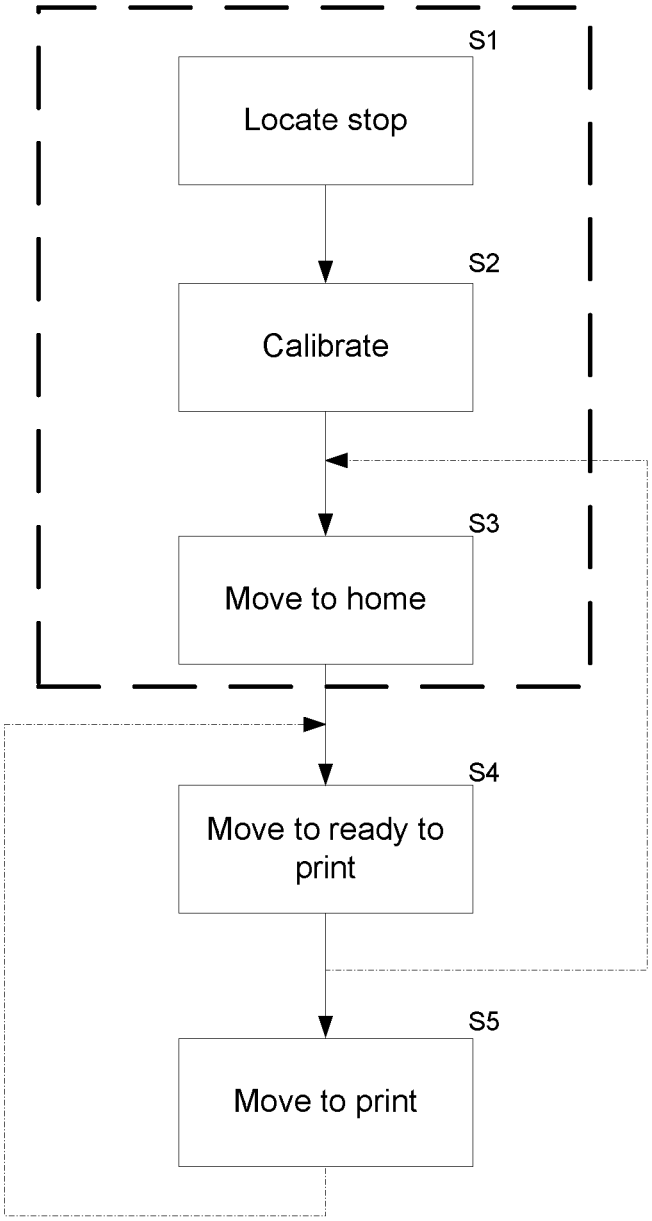
FIG. 6 is a flowchart showing, at a high level, control of the position of the printhead relative to a printing surface.
Figure 7:
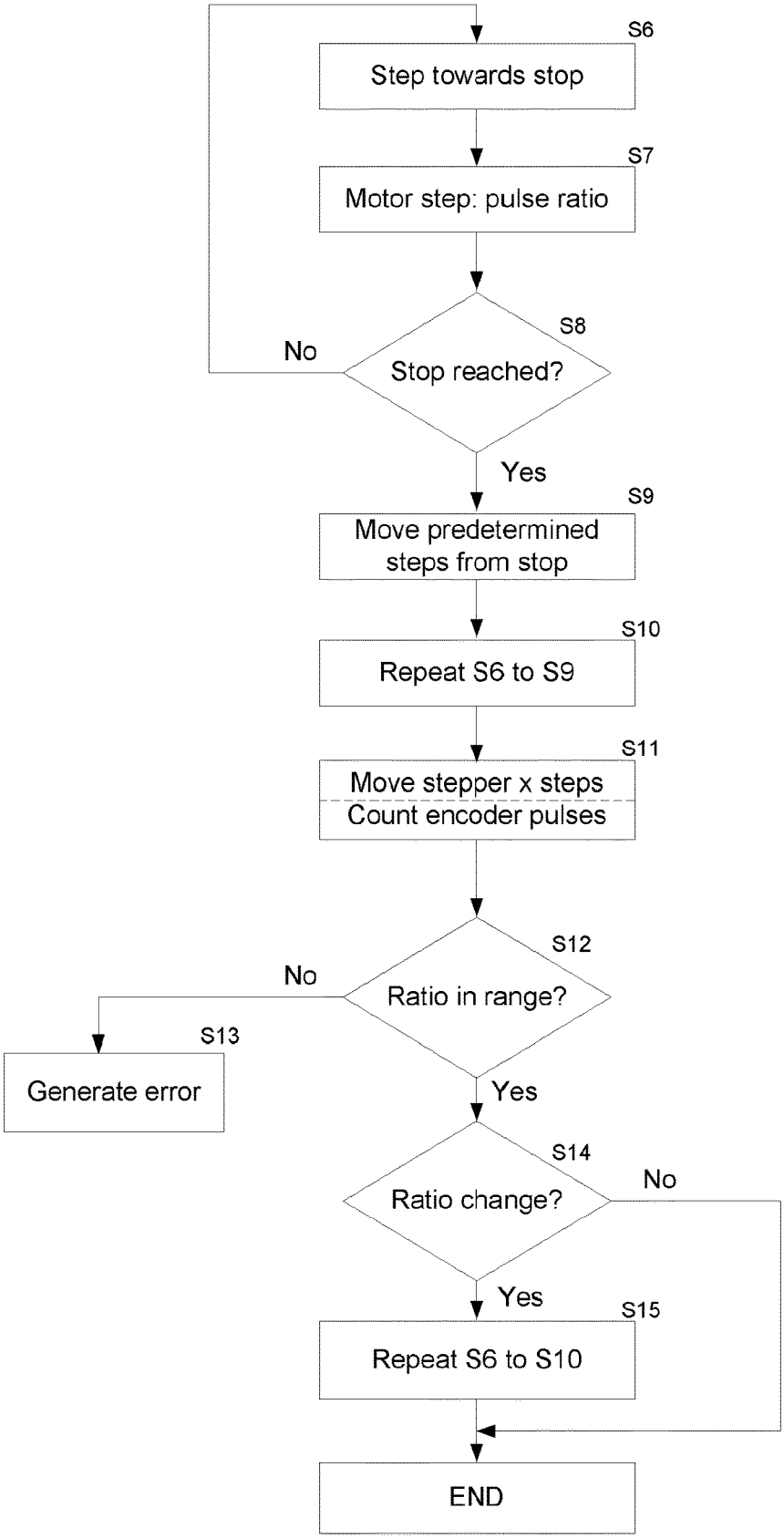
FIGS. 7 to 9 are flowcharts showing parts of the processing of FIG. 6 in further detail.

FIG. 7 shows the processing of steps S1 to S3 of FIG. 6 in further detail. At step S6 the stepper motor 20 is commanded to move one or more steps in a direction which corresponds to movement of the printhead assembly 6 towards the stop 21. At step S7 the ratio between the steps moved by the motor 20 and the pulses generated by the encoder 52 monitoring rotation of the printhead assembly 6 about the pivot 16 is monitored. At step S8 it is determined whether the monitored ratio deviates considerably from an expected ratio. Such deviation is taken to mean that the printhead assembly 6 is not able to rotate freely about the pivot 16 because the printhead assembly 6 has reached the stop 21, thereby impeding its further movement. If it is determined that the determined ratio does deviate from the expected ratio a determination is made at step S8 that the printhead assembly abuts the stop 21, and processing continues at step S9. Otherwise processing returns to step S6 where the motor is turned so as to move the printhead towards the stop 21.

In one embodiment, where the printhead is able to move freely it is expected that the ratio between motor steps and encoder pulses is 1:3.4, where the motor steps are quarter-steps of the motor's native resolution. This ratio takes into account the gearing provided by the drive wheel 19 and the pulley 17 as well as the number of quarter steps in a revolution of the motor and number of encoder pulses in a revolution of the pulley wheel 17. It is determined that the ratio has deviated from the expected value when the number of encoder pulses is at least twenty-one or more less than would be expected. That is, if 10 steps have been moved, it would be expected that 34 encoder pulses will have been received. If, however, 14 or less encoder pulses are received it is determined that the printhead 13 is unable to move freely and is instead in contact with the stop 21.

When it is determined at step S6 that the printhead assembly 6 abuts to stop (based on the monitored ratio between motor steps and encoder pulses) processing passes to step S9 where the motor is moved a predetermined number of steps in the opposite direction (i.e. to move the printhead assembly 6 away from the stop 21). Processing then passes to step S10 where the processing of steps S6 to S9 is repeated one or more times. This is to ensure that the location of the stop is accurately determined. When the processing of steps S6 to S9 is repeated at step S10, in one embodiment it may be determined that the ratio has deviated from the expected value when the number of encoder pulses is at least twelve or more less than would be expected. This lesser number is used on the basis that in processing as part of step S10 the printhead assembly begins motion from a relatively well known starting position (unlike when the processing of step S8 is carried out for a first time.

When the processing of steps S6 to S9 has been repeated a sufficient number of times, processing passes from step S10 to S11. It should be noted that from the processing of step S9 the printhead assembly 6 is located a predetermined number of motor steps from the stop 21. This is referred to as the home position for the printhead assembly 6. By accurately finding the location of the stop (through the repeated processing of steps S6 to S9) the home position is accurately defined relative to the location of the stop 21.

At step S11 the motor is commanded to rotate a predetermined number of steps (x steps) in a direction which moves the printhead assembly 6 farther away from the stop 21, then the same number of steps back towards the stop 21 (i.e. to the home position). While this movement is carried out the number of pulses generated by the encoder is counted. The predetermined number of steps is chosen so as to move the printhead assembly 6 towards the print roller 15 but not to cause the printhead to reach the print roller 15. That is, the movement of the printhead assembly 6 is unimpeded as the motor moves through the predetermined number of steps. In one embodiment the predetermined number of steps is 25 in each direction. After the motor stops moving a delay (e.g. 250 ms) is applied before taking a reading of encoder pulses to ensure that movement of the pulley wheel 17 has stopped before the number of encoder pulses is obtained.

The number of encoder pulses generated during movement of the stepper motor 20 through the predetermined number of steps in both directions is used to generate an updated ratio between motor steps and encoder pulses. In some embodiments the determined ratio may be processed together with ratios determined during previous calibration processes to determine an average ratio which is used in the processing described below. In one embodiment three determined ratios are used as a basis for determination of the average.

At step S12 a check is made to determine whether the updated ratio is within a predetermined range (e.g. within 5% or 10%) of a nominal ratio (e.g. the ratio 1:3.4 discussed above). If this is not the case, processing passes to step S13 where an error message is generated. This is because in all operating conditions it would be expected that the ratio of motor steps to encoder pulses would be reasonably close to some nominal ratio (1:3.4 in the example).

If the determined ratio is within a predetermined range of the nominal ratio, Processing passes from step S12 to step S14. Here it is determined whether the ratio determined has changed sufficiently from the nominal ratio. It should be noted, however that that the nominal ratio (1:3.4 in the example presented above) may be updated during processing. In particular each time a ratio within the predetermined range of the current nominal value is generated by the processing of step S11 a rolling overall average of the most recent four determined ratios may be generated, and this rolling average may then take the place of the nominal ratio. This updated nominal ratio is used in all parts of the processing requiring knowledge of a relationship between stepper motor steps and encoder pulses. If it is the case that the determined ratio has changed sufficiently from the nominal ratio, at step S15 steps S6 to S10 are repeated so as to ensure that the location of the stop 21 and consequently the home position are accurately known by basing the location of the stop 21 on the accurately determined step: encoder pulse ratio.

Figure 8:
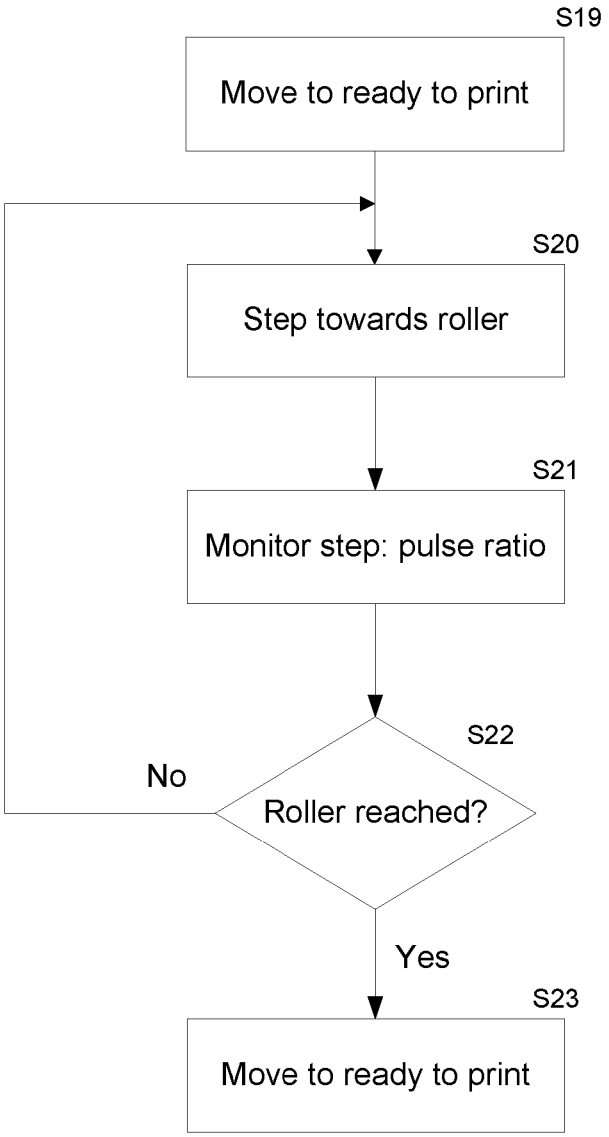

Referring back to FIG. 6, the processing of FIG. 7 corresponds to steps S1 to S3 of FIG. 6. FIG. 8 shows processing associated with step S4 of FIG. 6.

Referring to FIG. 8, at step S19 the stepper motor is commanded to move so as to move the printhead to the ready to print position. In a first operation, this position is defined to be a predetermined number of steps (e.g. 91 quarter steps) from the position at which the printhead contacted the stop. Thereafter, the movement is to the previously determined ready to print position.

At step S20 the stepper motor 20 is commanded to rotate in a direction which moves the printhead assembly 6 towards the print roller 15. The ratio between the steps through which the stepper motor 20 turns and the number of encoder pulses recorded is monitored at step S21 and used at step S22 to determine whether the print roller 15 has been reached by the printhead 13. This determination is based to similar processing to that described above with reference to step S8, specifically that a deviation from the expected ratio of steps to encoder pulses indicates that movement of the printhead assembly 6 is impeded, this time because the printhead assembly has made contact with the print roller 15. It is determined that the printhead assembly 6 has reached the print roller 15 when there is a difference of 12 encoder pulses from the expected ratio. For example, assuming again a ratio of 1 step to 3.4 encoder pulses when the printhead assembly moves freely, if movement of 10 steps equates to less than 22 encoder pulses, it will be determined that contact with the print roller 15 has been made.

While the printhead assembly 6 has not reached the print roller 15, processing returns from step S22 to step S20 and continues as described above. When it is determined at step S22 that the printhead assembly has reached the print roller 15, the stepper motor is moved in a predetermined number of steps in an opposite direction (i.e. to move the printhead assembly 6 away from the print roller 15) at step S23, this position spaced apart from the print roller 15 being referred to as the ready to print position. This position may be defined as that reached by moving the stepper motor 20 through 15 quarter steps.

Once in the ready to print position, the controller is configured to command the motor 20 to rotate a predetermined number of steps towards the print roller 15, that number of steps being determined by the pressure to be applied. The number of steps corresponding to a particular pressure is determined in advance by experimentation and stored in a look up table such that during operation of the printer, when a particular pressure is desired the controller commands the stepper motor to turn through the corresponding number of steps.

For example, the deviation of twelve encoder pulses referred to above has been found in one arrangement to result in a pressure of 3.5 kg being applied to the print roller 15 by the print head assembly 6. As such, commanding the stepper motor 20 to move the printhead assembly 6 towards the print roller by the number of steps moved away from the print roller 15 to reach the ready to print position will cause application of a pressure of 3.5 kg. The application of a further 5 steps has been found to cause application of a pressure of 7.9 kg.

Figure 9:
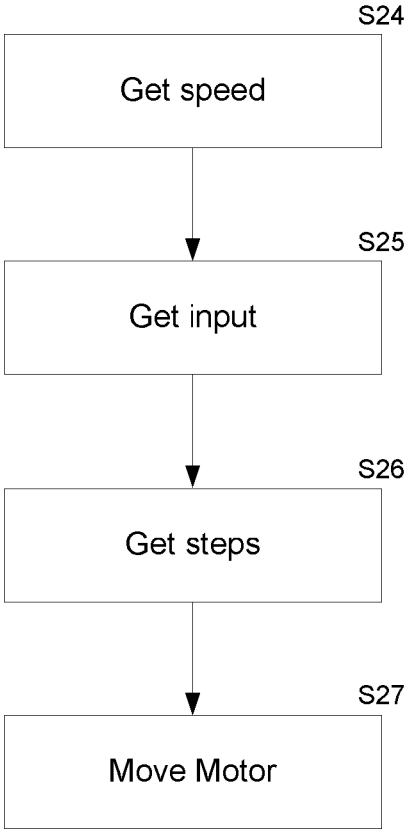

The pressure to be applied may be specified by a user as a percentage of a pressure to be applied given a particular substrate speed. A pressure of 50% may be considered to be nominal. In such a case the processing of FIG. 9 is used.

At step S24 a print speed is obtained. At step S25 user input indicating a percentage print force to be applied is obtained. At step S26 a force to be applied is determined and a number of steps through which the stepper motor 20 should be moved to apply that force is obtained. At step S27 the motor is moved through the determined number of steps to cause the printhead to 13 apply the determined force to the print roller 15.

The printer may store data indicating a minimum pressure (associated with user input of 0%) and a maximum pressure (associated with user input of 100%) when particular user input is received the pressure to be applied may be determined by linear interpolation from the stored minimum pressure and stored maximum pressure. Suitable nominal (i.e. 50%) pressures are 8 kg where the print speed is 500 $mms^{-1}$ and 4 kg where the print speed is 100 $mms^{-1}$.

During operation of the printer a stall detection system may be used. At the start of each printing operation a comparison is made between the number of encoder pulses which have been received and the number of steps through which the motor has been commanded to move. This is compared to the expected ratio between steps through which the motor has been commanded to move and encoder pulses. Where quarter stepping is used in control of the motor, if there is a difference of more than eight quarter steps between the steps commanded and encoder pulses received it is assumed that the stepper motor has stalled. It is therefore assumed that the motor has moved through more or less steps than it was commanded to move and the current position of the stepper motor is therefore updated by adding or subtracting a multiple of sixteen quarter steps until the ratio of steps to encoder pulses falls within an eight quarter step range of the expected ratio. This allows the position of the stepper motor to be more accurately monitored. All subsequent movements of the stepper motor are then based upon the updated position. It will be appreciated that the stall detection system of the type described in this paragraph is generally applicable to any arrangement in which an encoder provides information of actual movement caused by the provision of a number of steps to a stepper motor.

Referring back to FIG. 1, during labelling operations—in which labels are first printed and then removed from the backing paper—rotation of the motor 4 which is coupled to the label take-up spool 3 causes motion of the label web 14 through the labelling station 2. It is desirable that the motion of the label web can be accurately monitored so as to determine a linear speed of the label web 14 and/or a distance through which the label web has been moved.

Figure 10:
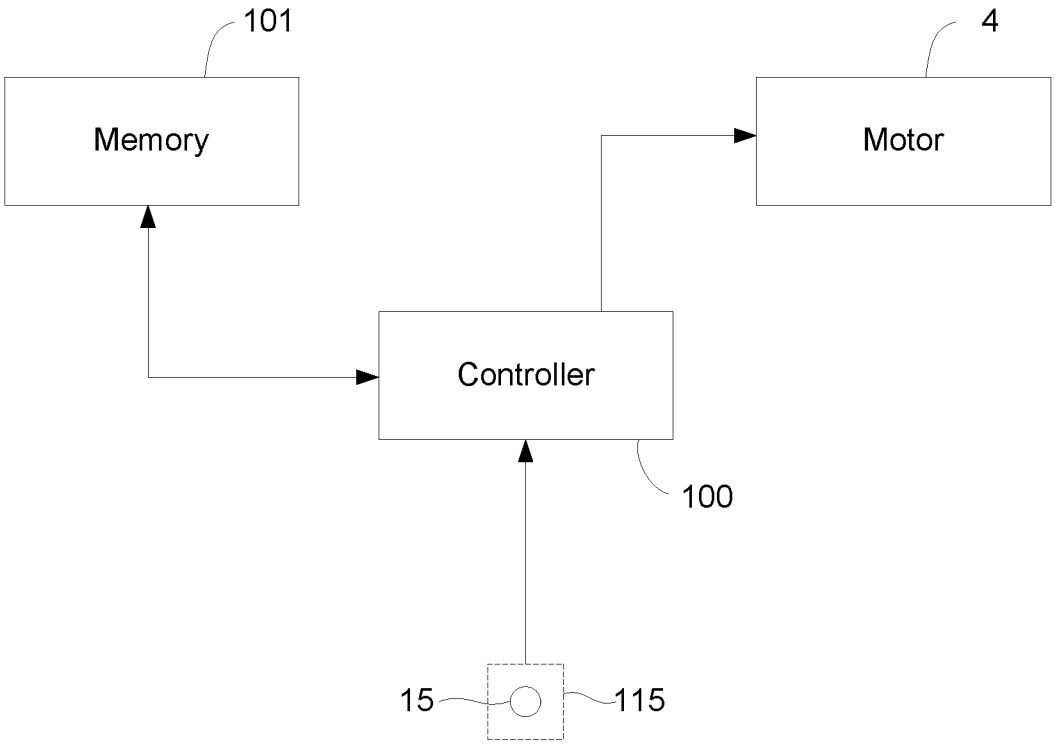
FIG. 10 is a schematic illustration of a controller and components connected thereto.
Figure 11:
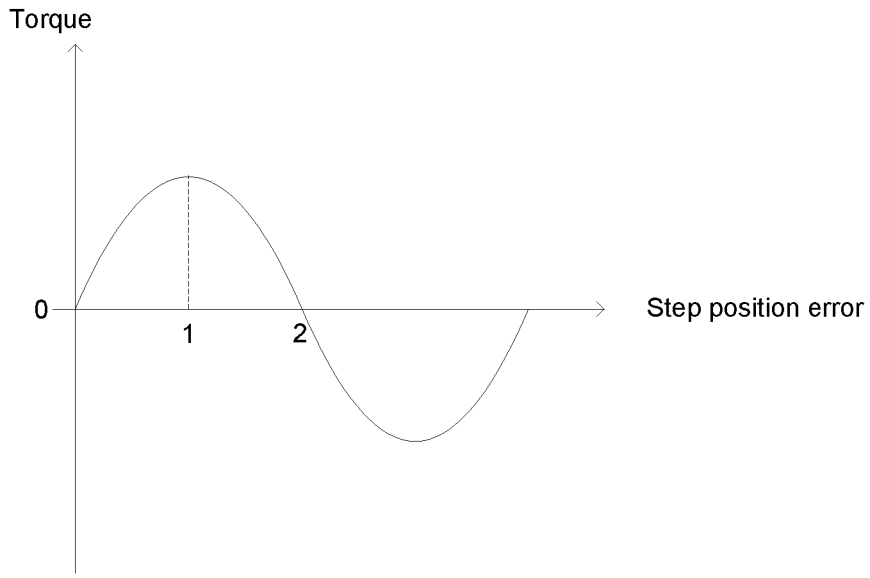
FIG. 11 is an example of a torque vs. angle characteristic for a stepper motor, as has been discussed above.

FIG. 10 is a schematic illustration of a controller 100 which controls rotation of the motor 4. A sensor 115 associated with the print roller 15 provides a signal indicative of its rotation to the controller 100 and this is used to provide accurate monitoring of the movement of the label web 14 past the printhead 13 and the print roller 15 as is described in further detail below. The controller 100 may control rotation of the motor 4 in any suitable way, but may use the signal received from the sensor 115 as a feedback signal to provide for closed-loop control of the motor 4.

The print roller 15 comprises a stainless steel shaft of diameter 8 mm and is coated with a silicon rubber coating having a Shore A hardness of 50-55 and a thickness of 2.75 mm. The primary purpose of the print roller 15 is to provide a backing support against which the printhead 13 presses the ribbon and label web 14 so as to effect thermal transfer printing onto a label. As such the print roller 15 acts as platen roller. As the label web 14 is advanced by rotation of the take-up spool 3 caused by rotation of the motor 4, the print roller 15 is caused to rotate. Rotation of the print roller 15 is a good indication of movement of the label web 14 past the printhead 13, particularly because of the pressure applied by the printhead 13 which presses the label web 14 against the print roller 15.

The coating of the print roller with the aforementioned silicon rubber has the effect of improving the consistency of rotation of the print roller 15 as the label web 14 moves along its path between the label supply spool 1 and the label take-up spool 3. This again contributes to making rotation of the print roller 15 an accurate indicator of movement of the label web past the print head 13.

In one particular embodiment the print roller 15 is provided with a magnet (e.g. part number BMN-35H which is marketed by Bomatec, Höri, Switzerland) which is mounted to the end of the print roller 15 such that it co-rotates with the print roller 15. The sensor 115 then takes the form of an encoder chip (e.g. part number AMS5040, marketed by ams R&D UK Ltd) which measures rotation of the magnet and hence print roller 15, and outputs a signal which is representative thereof to the controller 100. The signal comprises a plurality of pulses, and the controller 100 has knowledge of a predetermined number of pulses which are output by the sensor 115 in a single rotation of the print roller 15. Such knowledge can be stored in a memory 101 associated with the controller 100. This signal output by the sensor 115 is used by the controller 100 to monitor movement of the label web along the label web path. The diameter of the print roller 15 is known to the controller (and may again be stored in the memory 101). In one embodiment the print roller 15 has a diameter of 13.5 mm. Given knowledge of the diameter of the print roller 15, knowledge of the number of pulses generated by the sensor 115 in a single revolution of the print roller 15 and knowledge of a number of pulses received by the controller 100 from the sensor 115, the controller 100 can determine linear distance of label web which has moved past the print head 13 by determining a linear distance corresponding to the monitored rotation of the print roller 15.

It is preferable that the print roller 15 is as rigid as possible so that it does not deflect under print pressure from the printhead 13, as such stainless steel is a suitable material for the shaft of the print roller 15. That said, the pressure exerted by the printhead 13 to press the print ribbon and label web 14 against the print roller 15 will deform the silicon rubber with which the print roller 15 is coated. For example the silicon rubber may be compressed in a part of the print roller 15 against which the printhead 13 presses but may expand in another part of the print roller 15. This will cause the diameter of the print roller 15 to vary, the extent of deformation of the silicon rubber (and consequently the variation in diameter) being determined by the pressure applied by the printhead 13. The overall effect of the applied pressure may be to increase or decrease the diameter of the print roller 15. Where the area of the print roller 15 is constant, the pressure applied by the printhead 13 is determined by a number of steps through which the motor 20 is driven (FIG. 2) which determines the force applied to the print roller 15. As such, in use, the diameter of the print roller 15 may vary in dependence upon the pressure which the motor 20 causes the printhead 13 to apply to the print roller 15.

When determining a linear displacement of the label web 14 by monitoring rotation of the print roller 15, the controller 100 first determines a pressure being applied by the print head 6 (which is known given the number of steps through which the motor 20 has been driven, and which may be expressed in terms of a number of steps through which the motor 20 has turned relative to a reference position) and uses the determined pressure to determine a change in diameter of the print roller 15 caused by the applied pressure. The change in diameter for a particular pressure may be determined by a look-up operation. The data being looked up may be generated in advance by experiments in which the diameter of the print roller is measured for each of a plurality of pressures applied by the printhead 13 (which can conveniently be expressed in terms of a number of steps through which the motor 20 has turned relative to a reference position). For example, where a force of 10 kg is applied by the print head 13 to the print roller 15 of known width, this may have the effect of increasing the diameter of the print roller 15 by 2.5%. It will be appreciated that where the determined pressure does not correspond exactly to a stored value, interpolation may be used as part of the look-up operation.

Having determined a variation in the diameter of the print roller 15 based upon the applied pressure, the uncompressed diameter of the print roller 15 as stored in the memory 101 is modified based upon the data resulting from the look up operation to determine the effective diameter of the print roller 15. The effective diameter of the print roller 15, based upon the applied pressure, is then used when determining a linear distance which corresponds to a number of rotations of the print roller 15, that number of rotations being determined based upon the signal provided by the sensor 115 and the known number of pulses in a single revolution of the print roller 15.

In parts of the foregoing description, references to force and pressure have been used interchangeable. Where the surface against which the printhead 13 presses has constant area it will be appreciated that force and pressure are directly proportional, such that pressure may in practice be defined in terms of the force applied. However. the pressure applied (and consequently the extent of compression of the silicon rubber) will depend upon the width of the print roller 15 (i.e. the dimension extending into the plane of the paper in FIG. 2) against which the print head 13 applies pressure. The pressure—for a given applied force as determined by the number of steps through which the motor 20 is driven—is greater the narrower the roller, and so is the extent of compression of the silicon rubber, and vice versa. It was noted above that the described printer provides for two mounting positions for the printhead 13 (best seen in FIGS. 3 and 4) and the ability to vary the width of the print roller. As such, the controller 100 may additionally process information indicating the width of the print roller 15 against which the printhead 13 presses and use this width information to determine the effective diameter of the print roller 15.

Various controllers have been described in the foregoing description (particularly with reference to FIGS. 5 and 10). It will appreciated that functions attributed to those controllers can be carried out by a single controller or by separate controllers. It will further be appreciated that each described controller can itself be provided by a single controller device or by a plurality of controller devices. Each controller device can take any suitable form, including ASICs, FPGAs, or microcontrollers which read and execute instructions stored in a memory to which the controller is connected.

While various embodiments of the invention have been described above, it will be appreciated that modifications can be made to those embodiments without departing from the spirit and scope of the present invention. In particular, where reference has been made above to printing onto a label web, it will be appreciated that the techniques described above can be applied to printing on any substrate.

The invention claimed is:

1. A thermal transfer printer comprising:

first and second spool supports each being configured to support a spool of ribbon;

a ribbon drive configured to cause movement of ribbon from the first spool support to the second spool support;

a printhead configured to selectively transfer ink from the ribbon to a substrate, the printhead pressing the print ribbon and substrate together against a print roller;

a substrate drive configured to cause movement of the substrate past the printhead;

a sensor configured to monitor rotation of the print roller and generate a signal indicative thereof; and a controller configured to determine a measure of movement of the substrate and/or ribbon past the print roller based upon the signal output by the sensor and a quantity indicative of a diameter of the print roller;

wherein the quantity indicative of the diameter of the print roller is a quantity indicative of an effective diameter of the print roller as determined by the controller based upon a quantity indicative of the pressure applied by the printhead to the ribbon and the substrate against the print roller.

2. A thermal transfer printer according to claim 1, wherein said quantity indicative of the pressure is at least partially based upon the force applied by the printhead to the ribbon and substrate against the print roller.

3. A thermal transfer printer according to claim 1 or 2, wherein said quantity indicative of the pressure is at least partially based upon a parameter indicating a size of the print roller.

4. A thermal transfer printer according to claim 1, further comprising a motor configured to cause movement of the printhead towards and away from the print roller; wherein the controller is configured to provide a control signal to the motor to cause the motor to press the printhead against the print roller.

5. A thermal transfer printer according to claim 4, wherein the controller is configured to determine the control signal by:

obtaining a pressure to be applied to the print roller; and generating a control signal to be applied to the motor to cause the printhead to press against the printing surface with the obtained pressure.

6. A thermal transfer printer according to claim 4 or 5, wherein the motor shaft is coupled to the printhead by an inelastic coupling.

7. A thermal transfer printer according to claim 6, wherein such the elasticity provided by internal components of the motor is greater than the elasticity of the coupling between the printhead and the motor shaft.

8. A thermal transfer printer according to claim 7, wherein the elasticity provided by the internal components of the motor is provided by deviation of a rotor of the motor relative to the magnetic field in the stator of the motor from a position to which the rotor is commanded to move.

9. A thermal transfer printer according to claim 6, wherein the quantity indicative of an effective diameter of the print roller is determined based upon said control signal.

10. A thermal transfer printer according to claim 1, wherein the substrate drive comprises a substrate motor arranged to cause movement of the substrate past the printhead.

11. A thermal transfer printer according to claim 10, wherein the substrate drive comprises a stepper motor and the controller controls the stepper motor.

12. A thermal transfer printer according to claim 1, wherein the controller controls the substrate drive at least partially based upon the signal output by the sensor.

13. A labelling machine comprising a thermal transfer printer according to claim 1, wherein the substrate is a label web comprising a plurality of labels affixed to a backing web, and the substrate drive comprises a first and second substrate spool supports, the first substrate spool support being arranged to support a spool of label carrying web and the second substrate spool support being arranged to support a spool of web from which at least some labels have been removed.

14. A labelling machine according to claim 13, further comprising a labelling station arranged to remove labels from the label carrying web, the labelling station being located on a label path between the first and second substrate spool support.

15. A labelling machine comprising:

first and second ribbon spool supports each being configured to support a spool of ribbon;

a ribbon drive configured to cause movement of ribbon from the first spool support to the second spool support;

first and second label spool supports, the first label spool support being configured to support a spool of label carrying web and the second label spool support being configured to support a spool of web from which at least some labels have been removed;

a printhead configured to selectively transfer ink from the ribbon to labels of the label web, the printhead pressing the print ribbon and label web together against a print roller;

a label web drive configured to cause movement of the label web past the printhead;

a sensor configured to monitor rotation of the print roller and generate a signal indicative thereof; and a controller configured to determine a measure of movement of the label web and/or ribbon past the print roller based upon the signal output by the sensor and a quantity indicative of a diameter of the print roller;

wherein the quantity indicative of the diameter of the print roller is a quantity indicative of an effective diameter of the print roller as determined by the controller based upon a quantity indicative of the pressure applied by the printhead to the ribbon and the substrate against the print roller.

* * * * *